US006328800B1

(12) United States Patent
Yamazaki

(10) Patent No.: US 6,328,800 B1
(45) Date of Patent: Dec. 11, 2001

(54) DIP COATING APPARATUS

(75) Inventor: Junichi Yamazaki, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/276,728

(22) Filed: Mar. 26, 1999

(30) Foreign Application Priority Data

Mar. 27, 1998 (JP) ..... 10-100270

(51) Int. Cl.[7] ..... B05C 3/00
(52) U.S. Cl. ..... 118/425; 118/423
(58) Field of Search ..... 118/63, 423, 500, 118/501, 503, 600, 425

(56) References Cited

U.S. PATENT DOCUMENTS 5,586,579 * 12/1996 Diehl .

FOREIGN PATENT DOCUMENTS 59-127049 7/1984 (JP) .
59-225771 12/1984 (JP) .
63-7873 1/1988 (JP) .
1-107874 4/1989 (JP) .
3-213171 9/1991 (JP) .
4-29773 1/1992 (JP) .
5-7812 1/1993 (JP) .
5-88385 4/1993 (JP) .
9-265193 * 7/1997 (JP) .

* cited by examiner

*Primary Examiner*—Brenda A. Lamb
(74) *Attorney, Agent, or Firm*—Oblon, Spivak, McClelland, Maier & Neustadt, P.C.

(57) ABSTRACT

A dip coating apparatus including a substrate supporter which supports a substrate to be coated and which has a gas discharger which has a plurality of holes formed therein from which a gas is discharged; a gas supplying passage through which the gas is supplied to the gas discharger; and a gas supplying valve which is disposed at a position in the gas supplying passage and in which the gas is fed to the gas discharger when the gas supplying valve is opened, wherein a pressure loss in the gas discharger is greater than two times a pressure loss in the gas supplying passage between the gas supplying valve and the gas discharger.

4 Claims, 5 Drawing Sheets

DIP COATING APPARATUS

BACKGROUND OF THE INVENTION

1. Field of the Invention

The present invention relates to a dip coating apparatus, and particularly to a dip coating apparatus in which a substrate which is supported by a supporter having a gas discharger is dipped into a coating liquid to form a coating layer on the surface of the substrate. More particularly, the present invention relates to a dip coating apparatus suitable for forming a cylindrical photoconductor.

2. Discussion of the Background

As a typical coating method for forming a photoconductive layer on the peripheral surface of a cylindrical substrate, dip coating methods have been widely used. However, the dip coating methods have a drawback in that the thickness of a coated layer formed near a coat-starting end, i.e., an upper coating end, of the substrate is thinner than the other areas of a coated layer formed on the substrate, because the coated liquid on the upper part tends to drop downward during the drying time of the coated layer. This phenomenon is called as "a liquid dropping problem". In attempting to solve the liquid dropping problem, various dip coating methods have been disclosed. However, these methods have drawbacks in that the coating apparatus are complicated, the thickness of the coated layer is uneven, and/or the effect of the improvement is insufficient.

For example, Japanese Laid-Open Patent Publication No. 59-127,049 discloses dip coating methods in which, when a cylindrical substrate is pulled from a coating liquid, the density of vapor, which is generated by the vaporization of a solvent included in the coated liquid, is reduced. However, this coating method has following drawbacks:

(1) a gas passage from which the vapor is removed must be disposed in the upper part of the coating vessel, resulting in complications in operation of the coating apparatus; and (2) since the direction of the airflow is vertical to a surface of the cylindrical substrate, the thickness of the areas of the coated layer against which air is blown becomes thinner than the other areas of the coated layer formed on the substrate.

Japanese Laid-Open Patent Publication No. 59-225771 discloses a dip coating method in which when a cylindrical substrate is pulled from the coating liquid, a ring-shaped air control member blows air against the cylindrical substrate. However, the coating method also has a drawback in that the thickness of the formed layer is uneven because airflow in the coating vessel is uneven and the air which is discharged from the ring-shaped air doctor directly blows against the coated layer.

Japanese Laid-Open Patent Publication No. 63-7873 discloses a coating method in which a hood which is extendible and contractible is disposed in an upper part of the coating vessel to reduce the density of the solvent vapor. However, he coating apparatus becomes complicated, and in addition the apparatus is not practical because it takes a long time to change the substrate and the coating liquid.

Japanese Laid-Open Patent Publication No. 1-107874 discloses a coating method in which when a substrate is pulled from a coating liquid, an airflow is generated in a horizontal direction. This method also has a drawback in that the formed layer is uneven, which is the same drawback as that of the method disclosed in Japanese Laid-Open Patent Publication No. 59-127049 mentioned above.

Japanese Laid-Open Patent Publication No. 3-213171 discloses a coating method in which when a substrate is pulled from a coating liquid, air is blown against the peripheral surface of the cylindrical substrate while the air rotates around the surface. However, the method is complicated and the formed layer becomes uneven because air directly blows against the coated layer.

Japanese Laid-Open Patent Publication No. 4-29773 discloses a coating method in which when a substrate is pulled from a coating liquid, air which is discharged from nozzles blows against the substrate in a direction of the tangent line of the cylindrical substrate. However, the formed layer is uneven because the areas of the coated layer against which air is blown have less thickness than the other areas of the coated layer.

In addition, in attempting to solve the liquid dropping problem, for example, Japanese Laid-Open Patent Publications Nos. 5-7812 and 5-88385 have disclosed coating methods. However, these methods also have the drawbacks in that the apparatus are complicated and a resultant coated layer tends to be uneven.

Further, halogen-containing solvents such as methylene chloride have been typically used for the charge transporting layer coating liquid. However, currently the halogen-containing solvents cannot be used or are regulated in order to avoid environmental pollution and to prevent the ozone layer from being damaged. When other solvents are used as the solvents of the coating liquids, the liquid dropping problem tends to occur more frequently because the evaporating speed of the solvents is generally slower than that of the halogen-containing solvents.

In addition, currently polymers which have good abrasion resistance are used as binder resins of photoconductive layers, or polymer charge transporting materials are used in charge transporting layers, in order to prolong the life of photoconductors. In these cases, the coating liquids have higher viscosity than ever, and therefore the coating liquids are diluted when the liquids are coated, resulting in frequent occurrence of the liquid dropping problem.

In attempting to solve these problems and to form a photoconductor having a uniform coated layer, the present inventor and another inventor propose in Japanese Laid-Open Patent Publication No.9-265193 a dip coating apparatus in which a substrate which is supported from the inside thereof by a substrate supporter having a gas discharger which is cylindrical and which is porous is dipped into a coating liquid to form a uniform coating layer on the substrate, wherein a gas discharged from the gas discharger blows downward against the surface of the coating liquid. However, when a photoconductor is manufactured even by this coating apparatus, the photoconductive layer formed on a substrate sometimes has uneven thickness. In addition, when a plurality of photoconductors are manufactured at the same time using this coating apparatus, a problem which occurs is that each thickness of the resultant photoconductive layers is different from each other.

Because of these reasons, a need exists for a dip coating apparatus by which a plurality of photoconductors having a uniform photoconductive layer can be manufactured at the same time.

SUMMARY OF THE INVENTION

Accordingly, an object of the present invention is to provide a dip coating apparatus by which a uniform photoconductive layer can be formed on a substrate.

Another object of the present invention is to provide a dip coating apparatus by which a plurality of photoconductors having a uniform photoconductive layer can be manufactured at the same time.

Briefly these objects and other objects of the present invention as hereinafter will become more readily apparent can be attained by a dip coating apparatus including:

a substrate supporter which supports a substrate to be coated and which has a gas discharger which has a plurality of holes formed therein from which a gas is discharged;

a gas supplying passage through which the gas is supplied to the gas discharger; and a gas supplying valve which is disposed at a position in the gas supplying passage and which feeds the gas to the gas discharger when the gas supplying valve is opened, wherein the pressure loss at the gas discharger is greater than two times the pressure loss at the passage between the gas supplying valve and the gas discharger.

The gas supplying passage between the gas supplying valve and the gas discharger is preferably a tube having an inside diameter of not less than about 3 mm and a Reynolds number of not greater than about 2300.

The apparatus may further include a pressure releasing valve which is disposed at a position between the gas supplying valve and the gas discharger and which releases the pressure in the gas supplying passage.

Alternatively, the pressure releasing valve can be replaced with a decompression device.

In another aspect of the present invention, a dip coating apparatus is provided which includes:

a plurality of substrate supporters, each of which supports a substrate to be coated and which has a gas discharger which has a plurality of holes formed therein from which a gas is discharged;

a gas supplying passage which is branched from a branching point and through which the gas is supplied to each the gas discharger; and a gas supplying valve which is disposed at a position in the gas supplying passage, which is upstream from the branching point, and which valve feeds the gas to each the gas discharger when the valve is opened, wherein the difference between a maximum value and a minimum value of pressure loss in the branched gas supplying passage is not greater than about 500 Pa.

The difference between a maximum value and a minimum value of the pressure loss between the gas dischargers is not greater than about 500 Pa.

The gas supplying passage from the gas supplying valve and the gas dischargers is preferably a tube having an inside diameter of not less than about 3 mm and a Reynolds number of not greater than about 2300.

The apparatus may have a pressure releasing valve at a position between the gas supplying valve and the branching point of the gas supplying passage and which releases the pressure in the gas supplying passage.

Alternatively, the pressure releasing valve can be replaced with a decompression device.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DESCRIPTION OF THE PREFERRED EMBODIMENTS

The present invention is explained in detail referring o the drawings.

Figure 1:
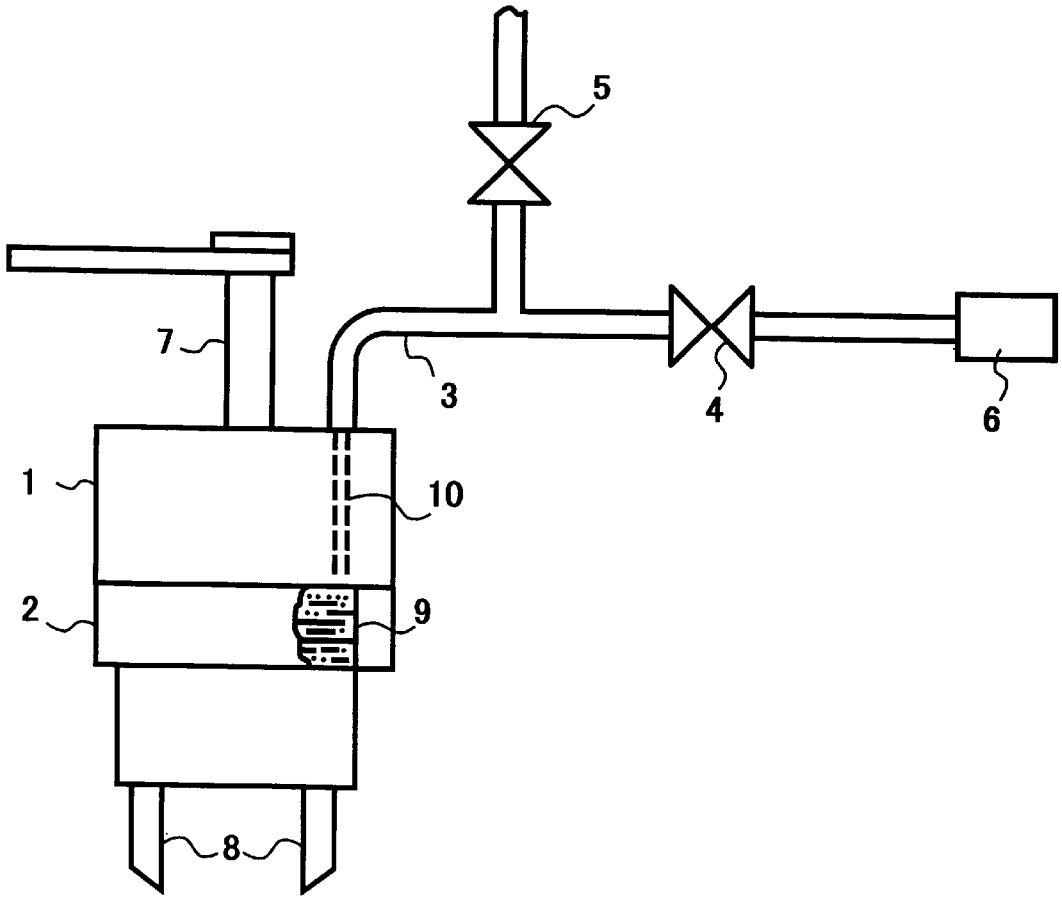
FIG. 1 is a schematic view illustrating an embodiment of the substrate supporter of the dip coating apparatus of the present invention.

FIG. 1 is a schematic view illustrating a substrate supporter 1 of the dip coating apparatus of the present invention. In order to show the gas discharger, a part of the substrate supporter 1 is removed therefrom. In FIG. 1 when a gas supplying valve 4 is opened while a pressure releasing valve 5 is closed, a gas supplied from a gas supplying source 6 passes through a gas feeding tube 3 and a penetration hole 10 which penetrates through a substrate supporter 1 and enters into a gas discharger 9 which is cylindrical and which has a plurality of holes formed therein. The gas discharger 9 preferably includes a porous material from which a gas is discharged. The pressure loss in the gas discharger 9 is greater than two times the pressure loss in the gas supplying passage, i.e., the gas feeding tube 3 and the penetration hole 10, which is placed between the gas supplying valve 4 and the gas discharger 9. Therefore the gas is uniformly discharged from the gas discharger 9, although the entrance of the gas to the gas discharger 9 is only the penetration hole 10. The flowing direction of the gas discharged from the gas discharger 9 is changed by a hood 2 so as to flow downward.

When it is desired to stop discharging the gas from the gas discharger 9, the gas supplying valve 4 is closed and the pressure releasing valve 5 is opened at the same time. When the pressure releasing valve 4 is opened, the pressurized gas staying inside the gas feeding tube 3, the penetration hole 10 and the gas discharger 9 is discharged through the pressure releasing valve 5. Thus, the gas discharging from the gas discharger 9 is rapidly stopped.

In FIG. 1, coating substrate supporting pawls 8 can rotate to pressingly contact the inside of a cylindrical substrate whose outside surface is to be coated. Thus, the cylindrical substrate can be securely supported. Alternatively, the cylindrical substrate may be supported with a rubber supporter which has an outside diameter smaller than the inside diameter of the substrate to be coated and which can support the substrate by expanding upon application of pressure from the inside of the rubber supporter.

Figure 2:
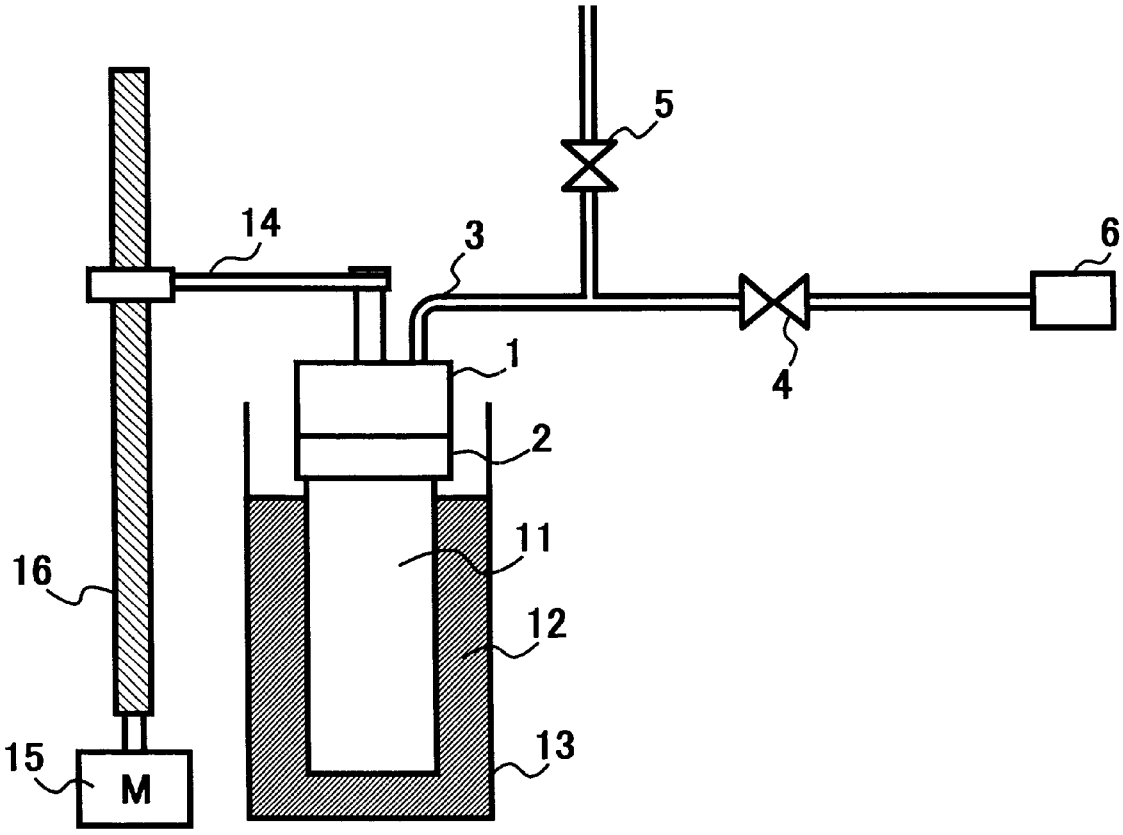
FIG. 2 is a schematic view illustrating an embodiment of the dip coating apparatus of the present invention.

In FIG. 1, numeral 7 denotes a connector which connects the substrate supporter 1 with an arm 14 shown in FIG. 2.

FIG. 2 is a schematic view illustrating an embodiment of the dip coating apparatus of the present invention.

In FIG. 2, when a motor 15 rotates a ball screw 16, an arm 14 with which the substrate supporter 1 is connected by means of the connector 7 goes up and down. The dip coating is performed as follows:

(1) a cylindrical substrate 11 to be coated is supported with the substrate supporter 1 having the gas discharger 9;

(2) the motor 15 is driven so as to lower the arm 14, which results in lowering of the substrate 11, and thereby the substrate 11 is dipped into a coating liquid 12 in the coating vessel 13;

(3) in the dropping movement of the substrate 11, the gas supplying valve 4 is opened while the pressure releasing valve 5 is closed, to supply the gas supplied from the gas supplying source 6 to the gas discharger 9 through the gas supplying passage, i.e., the gas feeding tube 3 and the penetration hole 10 (shown in FIG. 1), resulting in uniform discharge of the gas from the gas discharger 9;

(4) the gas, which is uniformly discharged from the porous material of the gas discharger 9, is forced to flow downward by the hood 2;

(5) the discharged gas controls the content of vapor of the solvent, which is included in the coating liquid 12, near the surface part of the coating liquid 12, and in addition the gas accelerates the evaporation of the solvent near the surface part of the coating liquid 12, which resulting in increase of the solid content of surface part of the coating liquid 12; and (6) the motor 15 is then driven so as to raise the substrate 11, and thereby the substrate 11 is coated with the coating liquid 12.

Thus, by using the dip coating apparatus, a layer having an even thickness is formed on the surface of the substrate 11. In addition, it is preferable to discharge the gas from the gas discharger 9 during the substrate raising operation because of avoiding a dropping problem by rapidly drying the coated layer.

Suitable materials for use as the porous material of the gas discharger 9 include moldings which are made, for example, by containing in a mold a powder such as plastics, glass or metals and then heating the powder upon application of pressure to form a cylindrical molding or a glass-shaped molding having a hole at the center of the bottom thereof. Suitable plastic powders useful for making the moldings include powders of polyethylene having super high molecular weight because of having good durability and hardly generating dust. The particle diameter thereof is preferably from about 20 to about 300 $\mu$m. The thickness of the porous part of the gas discharger 9 is preferably from about 1 mm to about 7 mm, and more preferably from about 2 mm to about 4 mm, to obtain a porous part having good strength and good gas discharging property such that a gas is uniformly discharged from the porous part.

Figure 3:
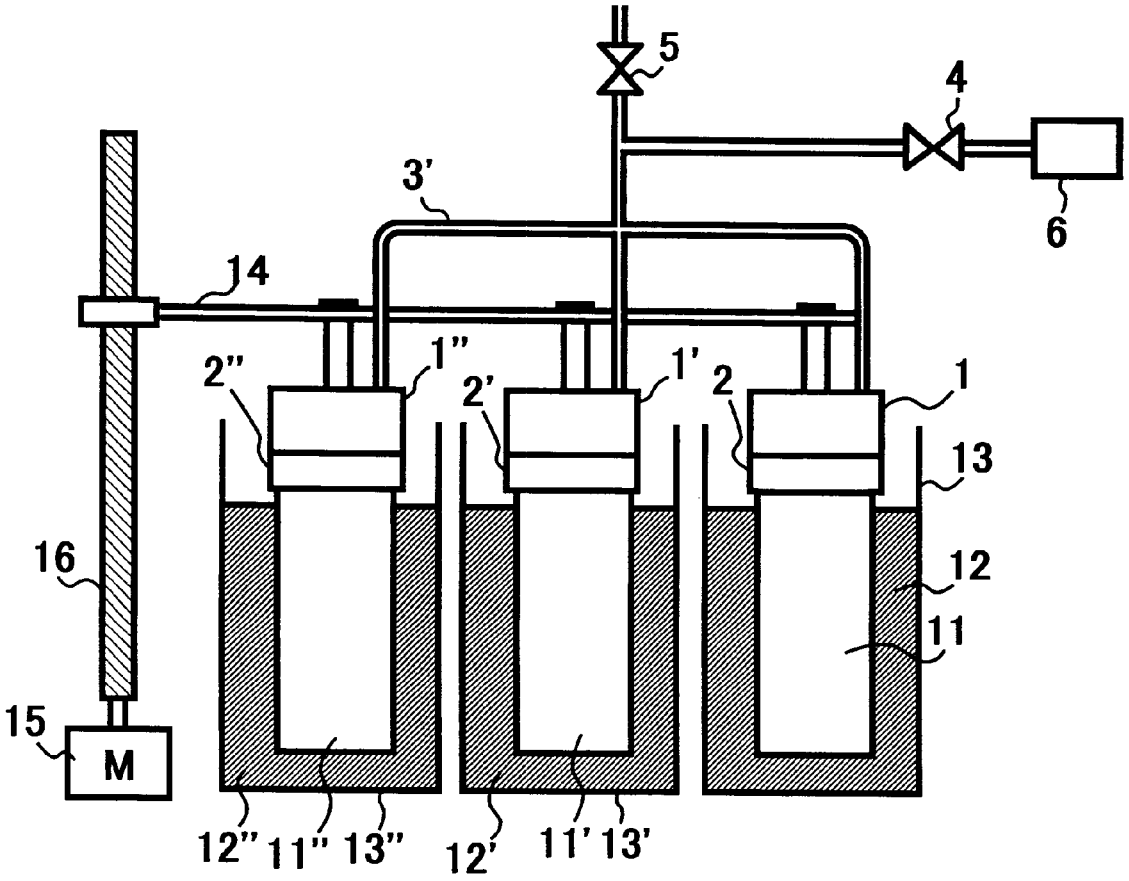
FIG. 3 is a schematic view illustrating an embodiment of the dip coating apparatus of the present invention in which a plurality of substrates can be dip-coated.

FIG. 3 is a schematic cross-sectional view illustrating an embodiment of the dip coating apparatus of the present invention in which a plurality of substrates can be coated.

In FIG. 3, a plurality of substrate supporters 1, 1' and 1" are connected with the arm 14 which can be raised and lowered. A gas supplying tube 3' is branched at a point after the gas supplying valve 4, and connects each penetration hole 10 (not shown in FIG. 3) of the substrate supporter 1, 1' and 1", to supply a gas to each gas dischargers 9 (not shown in FIG. 3) of the substrate supporters 1, 1' and 1". The difference between a maximum value and a minimum value of the pressure loss in the branched gas supplying passage is preferably not greater than 500 Pa.

The dip coating is performed as follows:

(1) cylindrical substrates 11, 11' and 11" to be coated are supported with the substrate supporter 1, 1' and 1" each having the gas discharger 9 (not shown in FIG. 3);

(2) the motor 15 is driven so as to lower the arm 14, resulting in lowering of the substrates 11, 11' and 11", and thereby the substrates 11, 11' and 11" are dipped into coating liquids 12, 12' and 12" in the coating vessels 13, 13' and 13" at the same time;

(3) in the lowering movement of the substrates 11, 11' and 11", the gas supplying valve 4 is opened while the pressure releasing valve 5 is closed, to supply the gas supplied from the gas supplying source 6 to each gas discharger 9 (not shown in FIG. 3) through the branched gas supplying passage and each penetration hole 10 (not shown in FIG. 3), resulting in uniform discharge of the gas from each gas discharger 9;

(4) the gas, which is uniformly discharged from the porous material of the gas discharger 9, is forced to flow downward by each hood 2, 2' or 2"; and (5) the motor 15 is then driven so as to raise the substrates 11, 11' and 11", and thereby each substrate 11, 11' or 11" is coated with each coating liquid 12, 12' or 12".

By allowing the difference between the maximum value and the minimum value of the pressure loss in the branched gas supplying passage to be not greater than 500 Pa, it is possible to decrease the difference between the gas discharging amounts from the gas dischargers 9 of the substrate supporters 1, 1' and 1". Therefore, a layer having a uniform thickness is formed on each surface of the substrates 11, 11' and 11", namely the difference of the thickness between the layers formed on the substrate 11, 11' and 11" is small. In addition, the difference of the thickness in each layer formed on the substrates 11, 11' and 11" is also small.

In addition, it is preferable that the difference between the maximum value and the minimum value of the pressure loss in the gas dischargers 9 of the substrate supporters 1, 1' and 1" is not greater than 500 Pa, to decrease the difference between the gas discharging amounts from the gas dischargers 9 of the substrate supporters 1, 1' and 1", and thereby the difference of the thickness between the layers formed on the substrates 11, 11' and 11" can be decreased and in addition the difference of the thickness in each layer can be decreased.

Further, in FIGS. 2 and 3, it is preferable to use, as the gas feeding passage, a gas feeding tube 3 and a penetration holes 10 each of which has an inside diameter not less than about 3 mm and Reynolds number not greater than about 2300 when a gas flows therethrough because the flowing amounts of the gas discharged from the gas dischargers 9 of the substrate supporters 1, 1' and 1" are independent of the setting position of the gas feeding tube or the turning angle. Therefore, the difference of the thickness in each layer can be decreased and in addition the difference of the thickness between the layers formed on the substrates 11, 11' and 11" can be decreased.

Furthermore, as shown in FIGS. 1, 2 and 3, it is preferable to provide the pressure releasing valve 5, in which the pressure loss is preferably less than that in the gas discharger 9, to rapidly releasing the pressurized gas which is contained in the gas feeding tube 3 or 3', the penetration hole 10 and gas discharger 9 when it is desired to stop discharging the gas. By this gas releasing operation, the gas discharging from the gas dischargers 9 is rapidly stopped, resulting in formation of a layer having a uniform thickness on each substrate.

Figure 4:
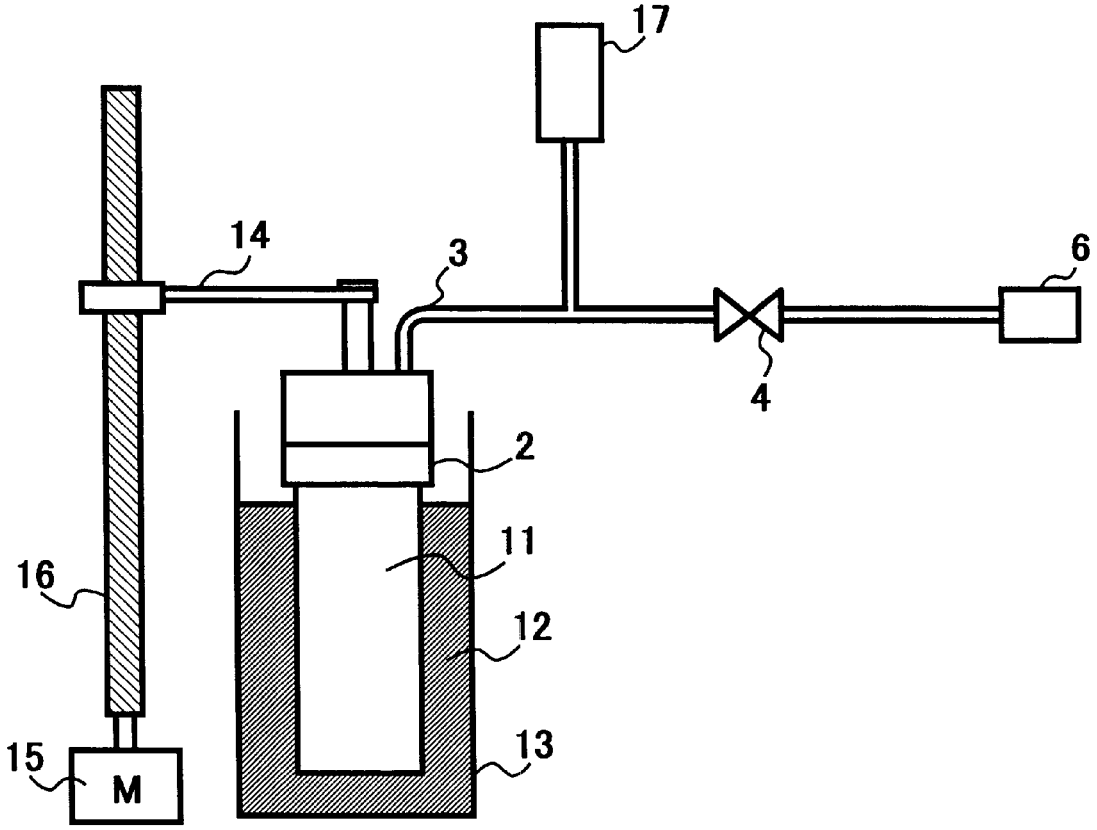
FIG. 4 is a schematic view illustrating another embodiment of the dip coating apparatus of the present invention.
Figure 5:
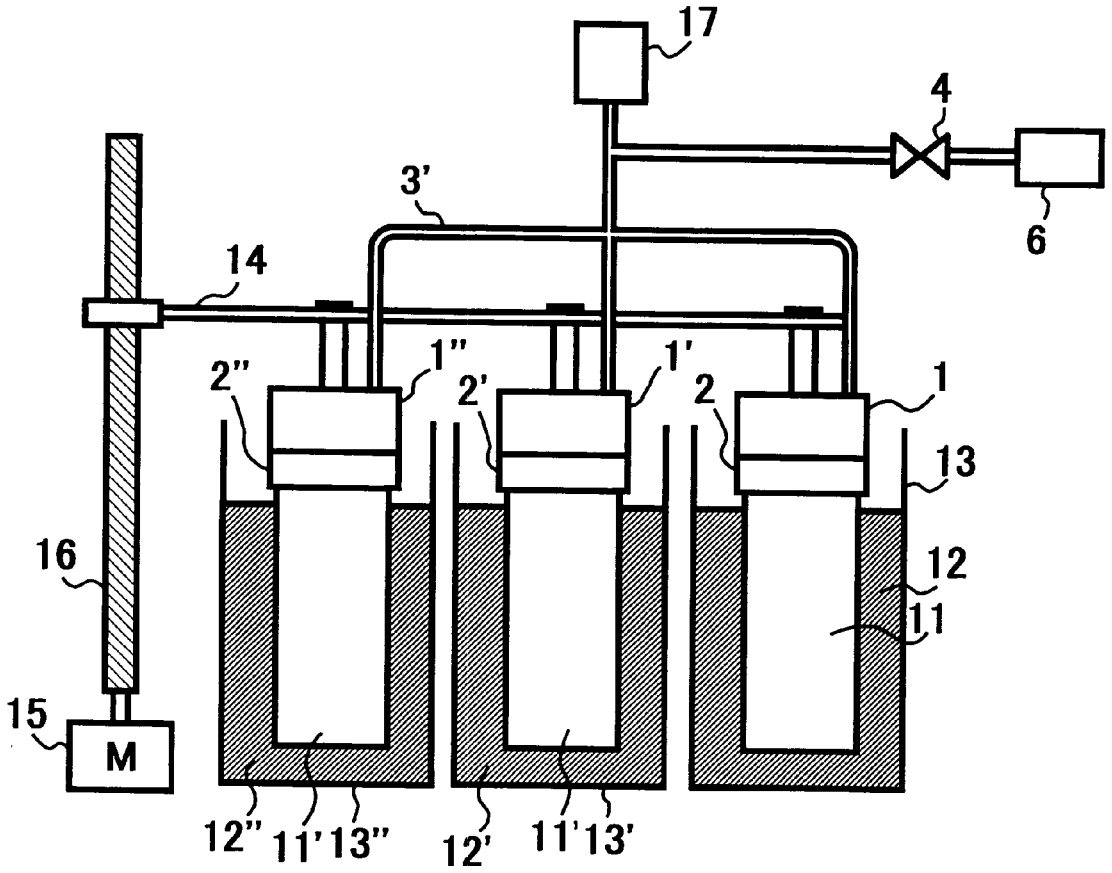
FIG. 5 is a schematic view illustrating another embodiment of the dip coating apparatus of the present invention in which a plurality of substrates can be dip-coated.

A decompression mechanism 17, which can decrease the pressure inside the gas supplying passage, may be used instead of the pressure releasing valve 5, as shown in FIGS. 4 and 5. By using the decompression mechanism 17, the pressure in the gas feeding tube 3 and the gas dischargers 9 is decreased more rapidly than in the case using the pressure releasing valve 5. In case the decrease of the pressure in the gas feeding tube 3 or 3', and the gas dischargers 9 is insufficient even when the pressure releasing valve is used, it is effective to use the decompression mechanism 17, which results in formation of coated layers having a uniform thickness.

Suitable devices for use as the decompression mechanism 17 include suction devices and decompression devices such as vacuum pumps, aspirators, pistons and the like.

By using the dip coating apparatus as shown in FIGS. 3 and 5, a layer having a uniform thickness can be formed on a plurality of substrates.

When an electrophotographic photoconductor is prepared using the dip coating apparatus mentioned above, various coating liquids can be coated. Specific examples of such coating liquids include charge transporting layer coating liquids including a composition containing a resin, a charge transporting compound and a solvent; a composition containing a polymerized charge transporting compound and a solvent; a composition of a resin, a polymerized charge transporting compound and a solvent; a composition containing a resin, a charge transporting compound, a polymerized charge transporting compound and a solvent; and the like. Various materials can be used as the resin, the charge transporting compound, the polymerized charge transporting compound and the solvent.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Formation of Undercoat Layer

The following components were mixed to prepare an undercoat layer coating liquid.

Soluble nylon resin 5

(Aramin CM-8000, manufactured by Toray Ltd.)

Methanol 95

The thus prepared undercoat layer coating liquid was coated on an aluminum cylinder by dip coating and then the coated layer was dried at 100° C. for 10 minutes. Thus an undercoat layer having a thickness of 0.3 $\mu$m was formed on the surface of the aluminum cylinder.

Formation of Charge Generating Layer

The following components were mixed and dispersed in a ball mill for 72 hours to prepare a dispersion.

Charge generating agent having the following (1)

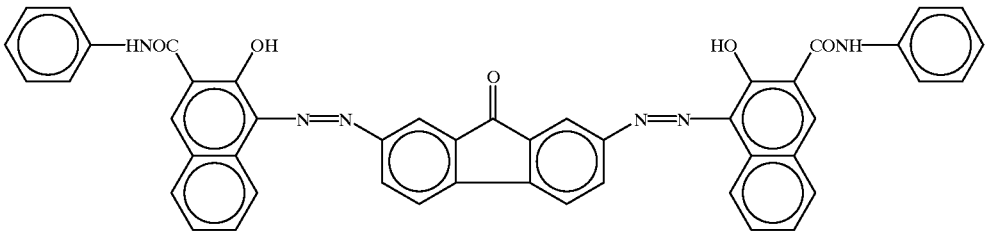

formula (1)

A circulating device, which is not shown in FIGS. 2 to 5, may be provided to collect a coating liquid 12 (or each coating liquid 12, 12' or 12"), which has overflowed from the coating vessel 13 (or each coating vessel 13, 13' or 13"), in a tank and then return the liquid 12 (or each liquid 12, 12' or 12") to the coating vessel 13 (or each coating vessel 13, 13' or 13").

Polyvinyl butyral 7

Tetrahydrofuran 145

Two hundred (200) parts of cyclohexanone were added in the dispersion and the dispersion was further dispersed in the ball mill for 1 hour. The thus prepared dispersion was diluted with cyclohexanone to prepare a charge generating layer coating liquid.

The charge generating layer coating liquid was coated on the surface of the previously prepared undercoat layer on the aluminum cylinder by dip coating and then dried at 100° C. for 10 minutes to prepare a charge generating layer having a thickness of 0.1 μm.

Formation of Charge Transporting Layer Coating Liquid

Seven (7) parts of a charge transporting material having the following formula (2) and 10 parts of polycarbonate resin (Panlite C-1400, manufactured by Teijin Ltd.) were dissolved in 83 parts of tetrahydrofuran to prepare a charge transporting layer coating liquid.

(2)

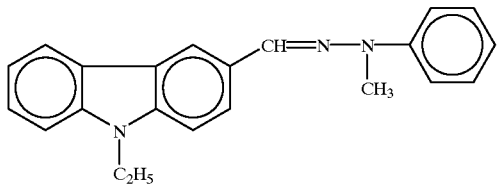

The thus prepared charge transporting layer coating liquid was coated using the dip coating apparatus as shown in FIG. 2. The aluminum cylinder having the undercoat layer and charge generating layer, which was supported with the substrate supporter 1, was dipped into the charge transporting layer coating liquid as the gas supplying valve 4 was opened while the pressure releasing valve 5 was closed. A nitrogen gas was supplied to the gas discharger 9 (not shown in FIG. 2) through the gas supplying passage, i.e. , the gas feeding tube 3 and the penetration hole 10 (not shown in FIG. 2), and discharged from the porous part of the gas discharger 9 in an amount of 100 ml/sec. When the aluminum cylinder reached to a lowest position in the coating liquid, the gas supplying valve 4 was closed and the pressure releasing valve 5 was opened for 1 second. The motor was then driven to pull the aluminum cylinder from the coating liquid to coat the coating liquid on the charge generating layer of the aluminum cylinder. The charge transporting layer was then dried in a dryer at a temperature of 120° C. for 30 minutes. The thus prepared electrophotographic photoconductor was cooled at room temperature in a dark place.

The pressure loss in the gas discharger 9 in the coating apparatus was 5000 Pa, and the pressure loss in the gas supplying passage, i.e., the gas feeding tube 3 and the penetration hole in the substrate supporter 1, was 2100 Pa. The pressure loss in the gas discharger 9 was more than two times that in the gas supplying passage.

The thickness of the charge transporting layer of the thus prepared photoconductor was shown in Table 1. The thickness was measured with an electronic micrometer (manufactured by Anritsu Corp.) and the thickness was measured at the positions of the photoconductor, of which the distance from the upper coating end of the charge transporting layer was 4, 6, 8, 10 and 12 mm. The target value of the thickness of the charge transporting layer was 20±2 μm.

Comparative Example 1

The procedure for preparation of the electrophotographic photoconductor in Example 1 was repeated except that the pressure loss in the gas supplying passage (i.e., the gas feeding tube 3 and the penetration hole 10 in the substrate supporter 1) was 3000 Pa. The gas discharge starting time, which is defined as a time when a nitrogen gas starts to discharge, in Comparative Example 1 was delayed more than in Example 1 by about 0.5 seconds.

The thickness of the charge transporting layer of the thus prepared photoconductor is shown in Table 1.

TABLE 1

| | Thickness at each position (μm) | | | | |
|---|---|---|---|---|---|
| | 4 mm | 6 mm | 8 mm | 10 mm | 12 mm |
| Example 1 | 5.3 | 15.6 | 19.6 | 20.3 | 20.1 |
| Comparative Example 1 | 3.1 | 10.2 | 14.2 | 17.3 | 19.4 |

As can be understood from Table 1, the thickness at the position which is apart from the upper coating end by 8 mm was within the target thickness range in Example 1, but the thickness at the position which is apart from the upper coating end by 10 mm was out of the target thickness range in Comparative Example 1.

Example 2

The procedure for preparation of the photoconductor in Example 1 was repeated except that the dip coating apparatus was replaced with a dip coating apparatus which could prepare nine photoconductors at the same time and which is similar to the apparatus shown in FIG. 3. The dip coating apparatus had nine substrate supporters 1 and coating vessels 13, and a gas supplying passage which was branched into nine passages (gas feeding tubes 3 and penetration holes 10) at a branching point therein. The maximum and minimum value of the pressure loss in the branched gas supplying passage was 1200 Pa and 770 Pa, respectively, and the difference between the values was 430 Pa, which was less than 500 Pa.

The thickness of the charge transporting layers of the thus prepared nine photoconductors was measured in the same way as performed in Example 1. The thickness measuring position was a position which was apart from the upper coating end by 12 mm.

The maximum value, minimum value and the average value of the thickness of the nine charge transporting layers are shown in Table 2. In addition, the difference between the maximum value and minimum value of the thickness is also shown in Table 2.

Comparative Example 2

The procedures for preparation and evaluation of the electrophotographic photoconductor in Example 2 were repeated except that the gas feeding tube 3 was changed. The maximum and minimum value of the pressure loss in the gas supplying passage (i.e., the gas feeding tube 3 and the penetration hole 10 in the substrate supporter 1) were 1350 Pa and 670, respectively, and the difference therebetween was 680 Pa, which as greater than 500 Pa.

The results are shown in Table 2.

TABLE 2

| | Thickness at 12 mm position (μm) | | | |
|---|---|---|---|---|
| | Maximum value | Minimum value | Difference between max. and min. values | Average value |
| Example 2 | 20.5 | 19.6 | 0.9 | 20.1 |
| Comparative Example 2 | 21.4 | 17.3 | 4.1 | 20.3 |

As can be understood from Table 2, the photoconductors prepared in Example 2 have an uniform charge transporting layer because the difference of the thickness between the nine charge transporting layers prepared in Example 2 is 0.9 μm, which is much smaller than that (4.1 μm) in Comparative Example 2.

Example 3

The procedures for preparation and evaluation of the photoconductors in Example 2 were repeated. The maximum and minimum value of the pressure losses in the nine gas dischargers were 5230 Pa and 4750 Pa, and the difference therebetween was 480 Pa, which was less than 500 Pa.

The results are shown in Table 3.

Comparative Example 3

The procedures for preparation and evaluation of the electrophotographic photoconductor in Example 3 were repeated except that the gas dischargers 9 were changed. The maximum and minimum value of the pressure losses in the nine gas dischargers were 5500 Pa and 4750, respectively, and the difference therebetween was 750, which was greater than 500 Pa.

TABLE 3

| | Thickness at 12 mm position (μm) | | | |
|---|---|---|---|---|
| | Maximum value | Minimum value | Difference between max. and min. values | Average value |
| Example 3 | 20.5 | 19.6 | 0.9 | 20.1 |
| Comparative Example 3 | 22.4 | 16.8 | 5.6 | 19.8 |

As can be understood from Table 3, the photoconductors prepared in Example 3 have a uniform charge transporting layer because the difference of the thickness between the nine charge transporting layers prepared in Example 3 is 0.9 μm, which is much smaller than that (5.6 μm) in Comparative Example 3.

Example 4

A dip coating apparatus which is as shown in FIG. 2 and in which a nylon tube whose inside diameter and length were 4 mm and 1 m, respectively, was used as the gas feeding tube 3. When air was flown to the tube in an amount of 100 ml/sec, Reynolds number of the tube was 2140. The method for measuring Reynolds number is described in, for example, page 109 of Chemical Engineering Handbook fourth edition edited by Japan Chemical Engineering Society and published by Maruzen Co., Ltd., incorporated herein by reference.

The airflow amount was not changed if the curvature of the nylon tube was changed. Namely, the airflow did not change even when the position of the gas feeding tube was changed. Therefore it can be realized that photoconductors having a uniform layer thickness are stably manufactured.

Comparative Example 4

In the dip coating apparatus used in Example 4, the gas feeding tube was replaced with a nylon tube whose inside diameter was 2 mm. The airflow amount (100 ml/sec) was changed when the curvature of the nylon tube was changed. In detailed description, when the nylon tube had four 90° turns whose radius of curvature was 15 mm, the airflow was decreased to 73 ml/sec.

The reason of the change of the airflow is considered to be that the airflow in the nylon tube in Comparative Example 4 was a turbulent flow and therefore the airflow amount changed if the curvature of the tube was changed, whereas the airflow in the nylon tube was a laminar flow in Example 4, and therefore the airflow amount did not change even if the curvature of the tube was changed.

Example 5

The procedure for preparation of the photoconductors was performed in Example 1 was repeated except that the dip coating apparatus was replaced by a dip coating apparatus which could prepare nine photoconductors at the same time and which is similar to the apparatus shown in FIG. 3. The dip coating apparatus had nine substrate supporters 1 and coating vessels 13, and a gas feeding passage which was branched into nine tubes at a branching point. The maximum and minimum value of the pressure losses in the gas supplying passage was 5200 Pa and 4900 Pa, respectively, and the difference between the values was 300 Pa, which was less than 500 Pa. In addition, the pressure loss of pressure releasing valve 5 was 4420 Pa.

The thickness of the charge transporting layer of a photoconductor which was randomly selected from the thus prepared nine photoconductors was measured in the same way as performed in Example 1. The target thickness was 20+2 μm.

The results are shown in Table 4.

Comparative Example 5

The procedures for preparation and evaluation of the electrophotographic photoconductor in Example 5 were repeated except that the pressure releasing valve 5 was replaced with a pressure releasing valve 5 whose pressure loss was 5500 Pa.

The results are shown in Table 4.

TABLE 4

| | Thickness of charge transporting layer at each position (μm) | | | | | |
|---|---|---|---|---|---|---|
| | 4 mm | 6 mm | 8 mm | 10 mm | 12 mm | 14 |
| Ex. 5 | 5.4 | 15.5 | 18.8 | 19.8 | 20.4 | 20.1 |
| Comparative Ex. 5 | 3.1 | 11.1 | 12.5 | 13.9 | 14.8 | 17.3 |

As can be understood from Table 4, the thickness at the position which is apart from the upper coating end by 8 mm was within the target thickness range in Example 5, but the thickness at the position which is apart from the upper coating end by 10 mm was out of the target thickness range in Comparative Example 5.

The reason is believed to be that when the pressure releasing valve 5 is opened, the pressure in the gas feeding tube 3 and the gas discharger 9 is smoothly decreased because the pressure loss in the pressure releasing valve 5 is less than that in the gas discharger 9 in Example 5, whereas in Comparative Example 5 the pressure in the gas feeding tube 3 and the gas discharger 9 cannot be smoothly decreased because the pressure loss in the pressure releasing valve 5 is greater than that in the gas discharger 9.

Example 6

The procedures for preparation and evaluation of the electrophotographic photoconductor in Example 1 were repeated except that the pressure releasing valve 5 was replaced with a decompression device 17, i.e., the dip coating apparatus as shown in FIG. 2 was replaced with a dip coating apparatus as shown in FIG. 4.

The thickness of the charge transporting layer was measured in the same way as performed in Example 1. The target thickness was 20±2 μm.

The results a re show n in Table 5.

TABLE 5

| | Thickness at each position (μm) | | | | |
|---|---|---|---|---|---|
| | 4 mm | 6 mm | 8 mm | 10 mm | 12 mm |
| Example 6 | 5.1 | 15.3 | 19.7 | 20.3 | 20.1 |

As can be understood from Table 5, the thickness at the position apart from the upper end by 8 mm was within the target thickness range in Example 6. The result was as good as that obtained in Example 1.

As can be understood from the description of the present invention, the dip coating apparatus of the present invention can coat a layer having a uniform thickness on a substrate.

In addition, the dip coating apparatus of the present invention can coat a layer having an even thickness on a plurality of substrates.

This document claims priority and contains subject matter related to Japanese Patent Application No. 10-100270, filed on Mar. 27, 1998, incorporated therein by reference.

Having now fully described the invention, it will be apparent to one of ordinary skill in the art that many changes and modifications can be made thereto without departing from the spirit and scope of the invention as set forth therein.

What is claimed as new and desired to be secured by Letter Patent of the United States is:

1. A dip coating apparatus comprising:

a coating vessel for containing a coating liquid;

a substrate supporter which supports a substrate to be coated and which has a gas discharger which has a plurality of holes formed therein from which a gas is discharged downwardly toward a surface of the coating contained in the coating vessel;

a gas supplying passage through which the gas is supplied to the gas discharger; and a pressure releasing valve which is disposed at a position in the gas supplying passage and which releases pressure in the gas supplying passage when the pressure releasing valve is opened wherein the substrate supported by said substrate supporter is dipped into the coating contained in the coating vessel to form a coated substrate and, wherein a pressure loss in the pressure releasing valve is not greater than a pressure loss in the gas discharger.

2. A dip coating apparatus comprising:

a coating vessel for containing a coating liquid;

a plurality of substrate supporters each of which supports a substrate to be coated and each of which has a gas discharger which has a plurality of holes formed therein from which a gas is discharged downwardly toward a surface of the coating contained in the coating vessel;

a gas supplying passage through which the gas is supplied to each said gas discharger; and a pressure releasing valve which is disposed at a position in the gas supplying passage and which releases pressure in the gas supplying passage when the pressure releasing valve is opened wherein the substrate supported by said substrate supporter is dipped into the coating vessel to form a coated substrate and, wherein a pressure loss in the pressure releasing valve is not greater than a pressure loss in the gas dischargers.

3. A dip coating apparatus comprising:

a coating vessel for containing a coating liquid;

a substrate supporter which supports a substrate to be coated and which has a gas discharger which has a plurality of holes formed therein from which a gas is discharged downwardly toward a surface of coating contained in the coating vessel;

a gas supplying passage through which the gas is supplied to the gas discharger; and a decompression device which is configured to generate negative pressure to decrease a pressure in the gas supplying passage whereby the substrate supported by said substrate supporter is dipped into the coating contained in the coating vessel to form a coated substrate.

4. A dip coating apparatus comprising:

a coating vessel for containing a coating liquid;

a plurality of substrate supporters each of which supports a substrate to be coated and each of which has a gas discharger which has a plurality of holes formed therein from which a gas is discharged downwardly toward a surface of the coating contained in the coating vessel;

a gas supplying passage through which the gas is supplied to the gas discharger; and a decompression device which is configured to generate negative pressure to decrease a pressure in the gas supplying passage whereby the substrate supported by said substrate supporter is dipped into the coating contained in the coating vessel to form a coated substrate.

* * * * *